United States Patent [19]

Cleaveland et al.

[11] 4,357,504

[45] Nov. 2, 1982

[54] BEARING AND JOURNAL MEANS FOR THE ROTATABLE CRANK-ARM ASSEMBLY OF A DISCONNECTING SWITCH

[75] Inventors: Charles M. Cleaveland, North Huntingdon; Peter M. Kowalik, Trafford, both of Pa.

[73] Assignee: Cleaveland/Price Enterprises, Inc., Trafford, Pa.

[21] Appl. No.: 219,880

[22] Filed: Dec. 24, 1980

[51] Int. Cl.[3] ..... H01H 31/30

[52] U.S. Cl. ..... 200/48 R; 200/48 A

[58] Field of Search ..... 200/48 R, 48 A, 48 KB; 308/30

[56] References Cited

U.S. PATENT DOCUMENTS

| | | | |
|---|---|---|---|
| 2,067,659 | 1/1937 | Crabbs | 200/48 R |
| 2,174,237 | 9/1939 | Crabbs | 200/48 R |
| 2,526,845 | 10/1950 | Bowie | 200/48 R |
| 3,192,332 | 6/1965 | Bernatt et al. | 200/48 A |

*Primary Examiner*—John W. Shepperd
*Attorney, Agent, or Firm*—Willard R. Crout

[57] ABSTRACT

An improved bearing and journal construction is provided for a high-voltage disconnecting switch of the type having supporting insulators and a rotatable crank-arm arrangement, with the operating thrust of the crank-arm being supported by simplified bearing discs running in a journal, the improvement residing in the fact that the hinge member about which the switch-blade pivots is separate from the journal member which bridges the hinge supporting insulator to the rotating insulator, and that the foregoing separation allows the journal member to be stamped out of plate material resulting in considerable economy over the cast construction known to prior art. A preferred bearing arrangement locates the discs under the crank-arm so that traditional machining of a bearing race on the crank-arm is eliminated for further economy.

5 Claims, 16 Drawing Figures

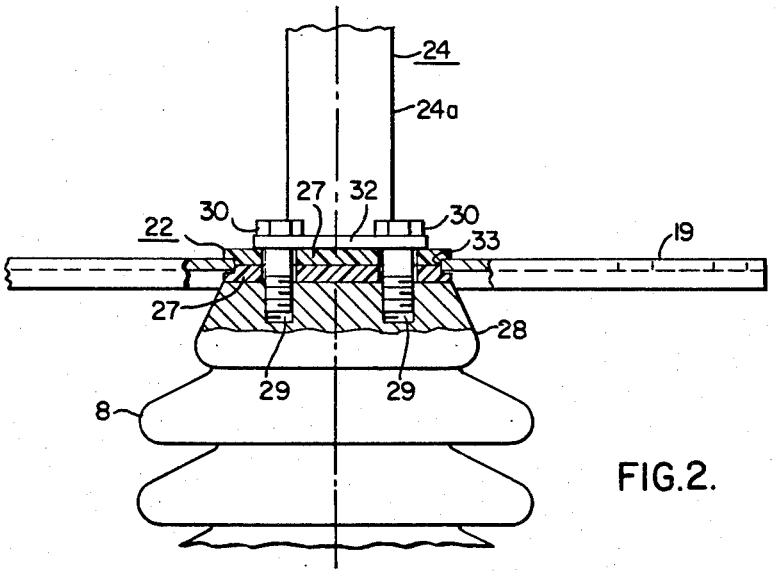
FIG.2.
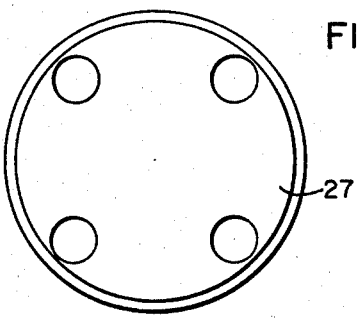
FIG.3.
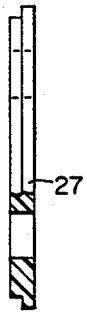
FIG.4.
FIG.5.
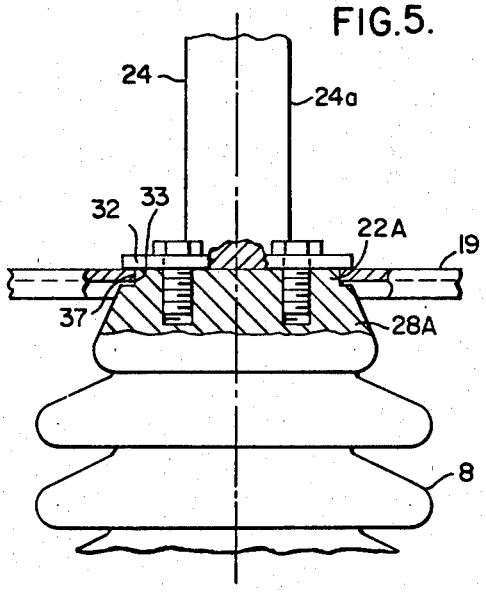
FIG.6.
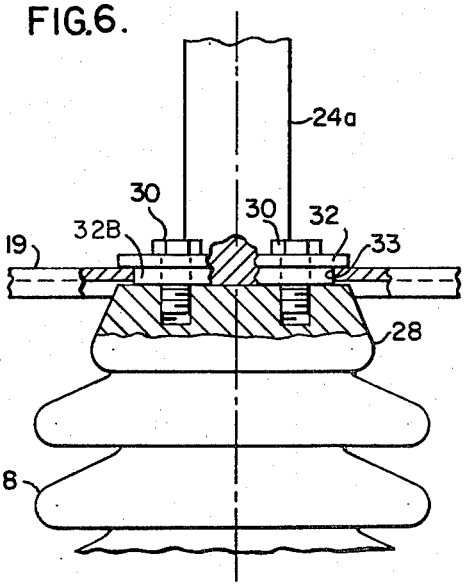

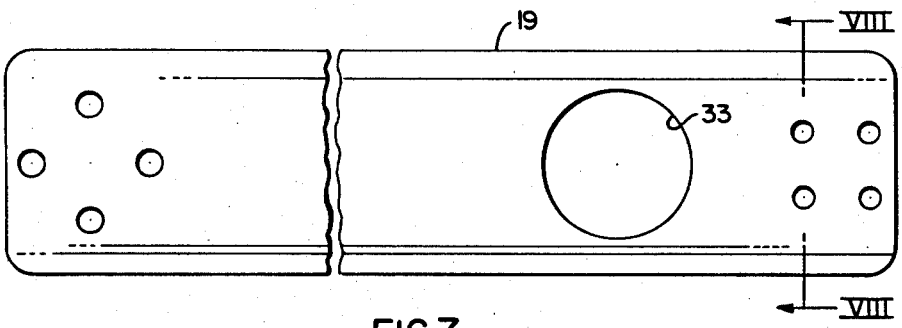
FIG.7.
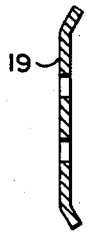
FIG.8.
FIG.11.
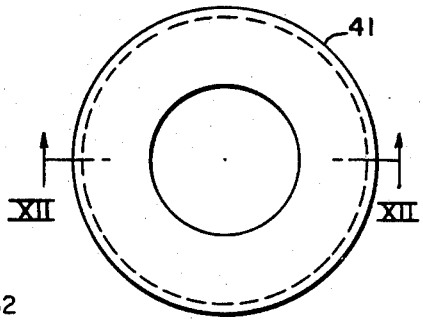
FIG.15.
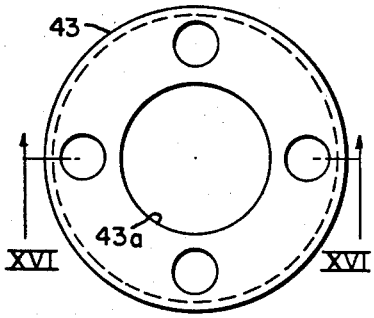
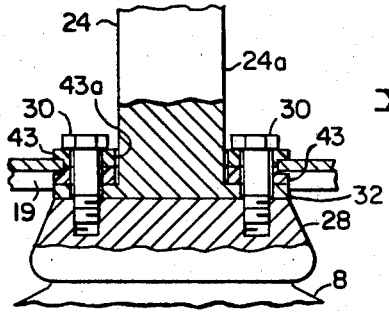
FIG.14.
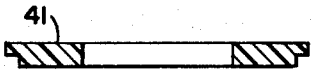
FIG.12.
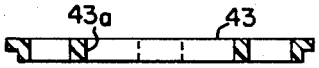
FIG.16.
FIG.10.
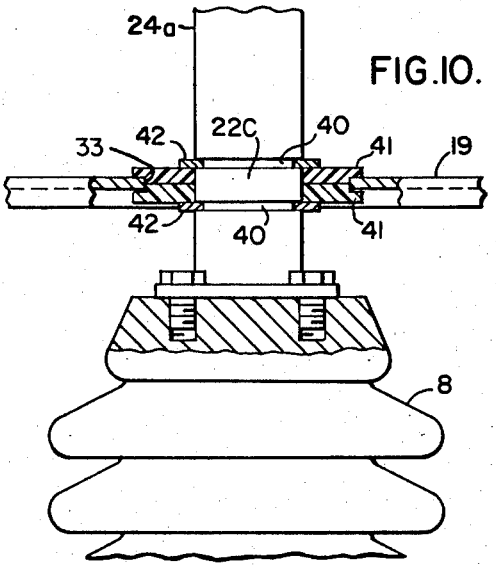
FIG.13.
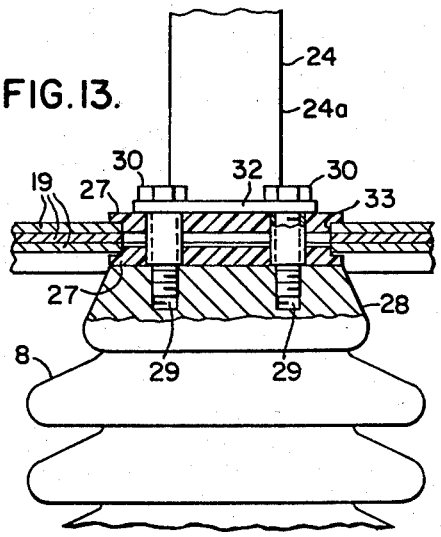

BEARING AND JOURNAL MEANS FOR THE ROTATABLE CRANK-ARM ASSEMBLY OF A DISCONNECTING SWITCH

BACKGROUND OF THE INVENTION

1. Field of the Invention

This invention relates to electrical high-voltage disconnecting switch structures of the type in which a rotatable post-type insulator support effects concomitant operative rotation of a movable remote crank-arm assembly, which, in turn, is mechanically linked to and operates a pivotally mounted swinging disconnecting switch-blade, which makes separable opening and closing contacting engagement with a spaced-apart stationary switch-jaw contact.

2. Description of the Prior Art

High-voltage disconnecting switches of the prior art have invariably utilized heavy, expensive metallic casting structures which bridge the central stationary post-insulator support of the switch and the end rotatable post-insulator support. The rotatable crank-arm assembly, which is operatively rotated by the end rotatable post-insulator support, has had expensive machining operations performed thereon to provide a resultant bearing means to accommodate the stationary heavy bridging conducting casting structure.

Such expensive machining operations performed upon the shank portion of the rotatable crank-arm assembly have necessarily considerably increased the overall cost of the disconnecting switch. There has correspondingly been created a need for an inexpensive bearing means for the rotatable crank-arm assembly of the switch where it rotatively passes through the bridging casting structure of the switch, the latter carrying electrical current from the pivot end of the movable switch-blade to the end line terminal of the switch.

Moreover, there has also additionally been a need to avoid the use of the usual heavy expensive conducting bridging casting structures, commonly used by all manufacturers of high-voltage disconnecting switches, and extending between the pivot end of the movable switch-blade and the end terminal pad of the switch.

SUMMARY OF THE INVENTION

The present invention relates to an improved bearing means for the rotatable crank-arm assembly of a disconnecting switch wherein improved economical bearing means are provided for supporting the rotatable crank-arm assembly of a disconnecting switch in a novel, inexpensive and simplified manner, so that there results an elimination of any expensive machining operations to be performed on the shank portion of the rotatable crank-arm assembly and to the supporting journal. As well known by those skilled in the art, many disconnecting switches are operated to their open and closed circuit positions by effecting the rotation of a rotatable post-type insulator support, which effects concomitant rotation of a supported crank-arm assembly. The crank-arm assembly, in turn, effects, through suitable mechanical linkage, a swinging opening and closing movement of a disconnecting switch-blade into and out of engagement with a relatively stationary cooperable break-jaw contact structure.

A general object of the present invention is to provide an improved economical bearing for the crank-arm assembly of a disconnecting switch of the rotatable crank-arm type, in which there is no necessity for performing expensive bearing machining operations upon the shank portion of the rotatable crank-arm assembly.

Another object of the present invention is to provide an improved supporting journal for the bearing, comprised of a conducting plate-like member in substitution of the usual heavy expensive casting structures of the prior art utilized by manufacturers as far as we are aware. In more particularity, the improved supporting journal of the present invention contemplates the use of one or more superimposed conducting flat plate members instead of the usual expensive casting structures requiring expensive machining which have heretofore been used in the art to our knowledge. Also the construction of the journal member from plate material provides for economy over cast material and allows fabrication by stamping which provide economy over machining of castings known to prior art.

Still a further object of the present invention is to provide an improved economical rotatable mounting arrangement for the crank-arm assembly of a disconnecting switch in which the journal plate is located on the lower side of the flange-support portion of the rotatable crank-arm assembly.

Yet another object of the invention is to provide an improved economical rotatable mounting arrangement for the crank-arm assembly of a disconnect switch in which the same journal plate is located above the flange support portion of the rotatable crank-arm assembly.

BRIEF DESCRIPTION OF THE DRAWINGS

Further objects and advantages will readily become apparent upon reading the following specification taken in conjunction with the drawings, in which:

FIG. 2 is a fragmentary enlarged detailed vertical sectional view of the bearing means for the rotatable crank-arm assembly of FIG. 1, illustrating attachment of the crank-arm assembly and the bearing discs to the insulator and illustrating the bearing support journal as a generally flat bus-bar like member;

FIGS. 3 and 4 are plan and side elevational views of the insulating bearing disc utilized in connection with the improved bearing means illustrated in FIG. 2;

FIG. 5 shows an alternate bearing arrangement;

FIG. 6 illustrates a further modified type of bearing arrangement;

FIGS. 7 and 8 illustrate, in a detailed fashion, the conducting flat plate or "pan", which is utilized in the present invention in substitution of the usual elaborate expensive casting structures of the prior art;

FIG. 10 is an enlarged fragmentary vertical sectional view taken through the bearing means of FIG. 9;

FIGS. 11 and 12 illustrate detailed views of the bearing discs employed in conjunction with the bearing support of FIG. 9;

FIG. 13 illustrates fragmentarily the use of a plurality of flat conducting journal plates used on disconnecting switches rated for higher current capacity, with the preferred general bearing arrangement as in FIGS. 1 and 2;

FIG. 14 illustrates a variation of FIG. 2; and

FIGS. 15 and 16 illustrate in an enlarged fashion the bearing discs used in the bearing means of FIG. 14.

DESCRIPTION OF THE PREFERRED EMBODIMENTS

Figure 1:
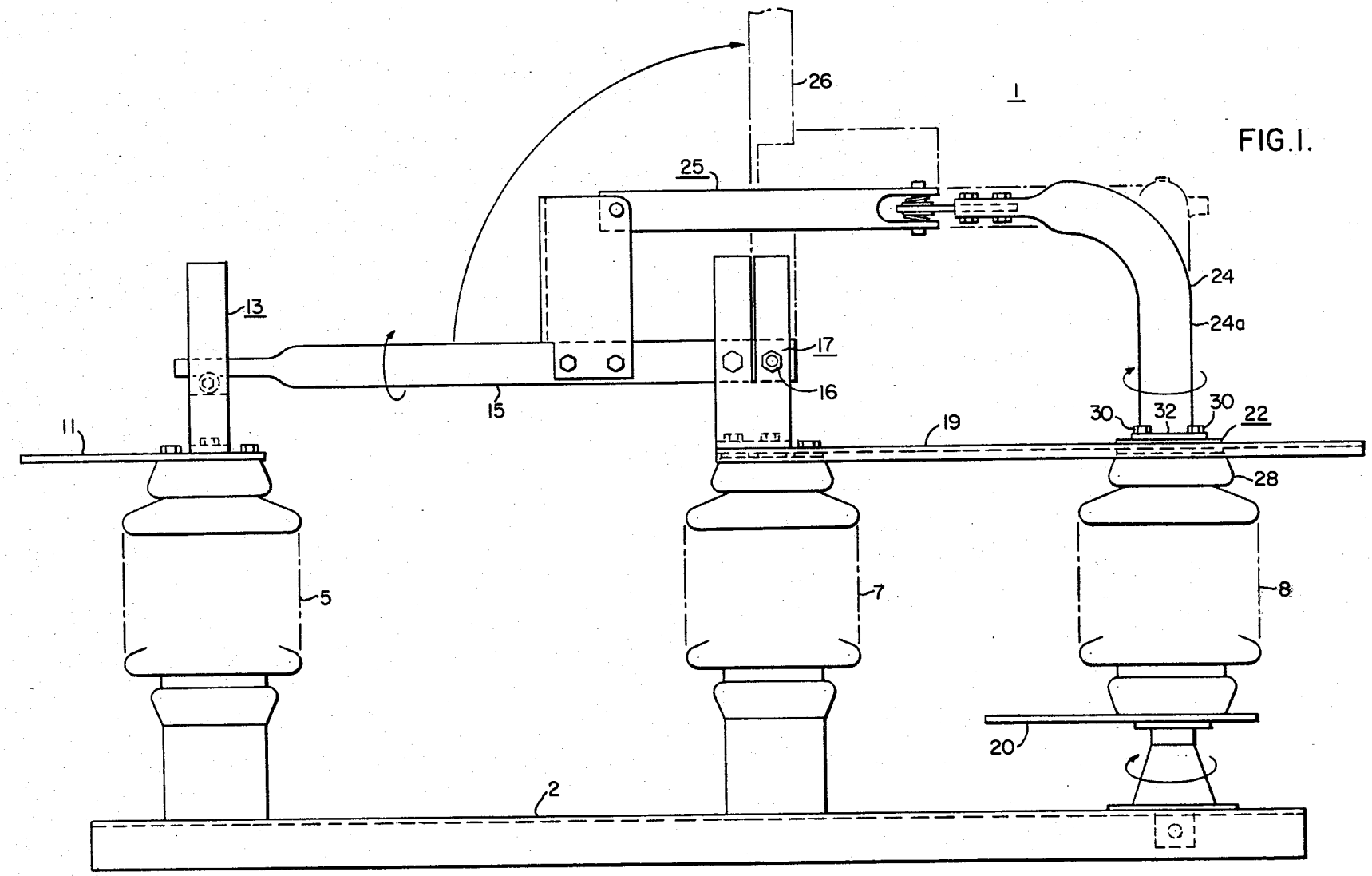
FIG. 1 is a side elevational view of a disconnecting switch structure embodying features of the present invention, the movable contact-blade assembly being illustrated in the closed-circuit position.
Figure 9:
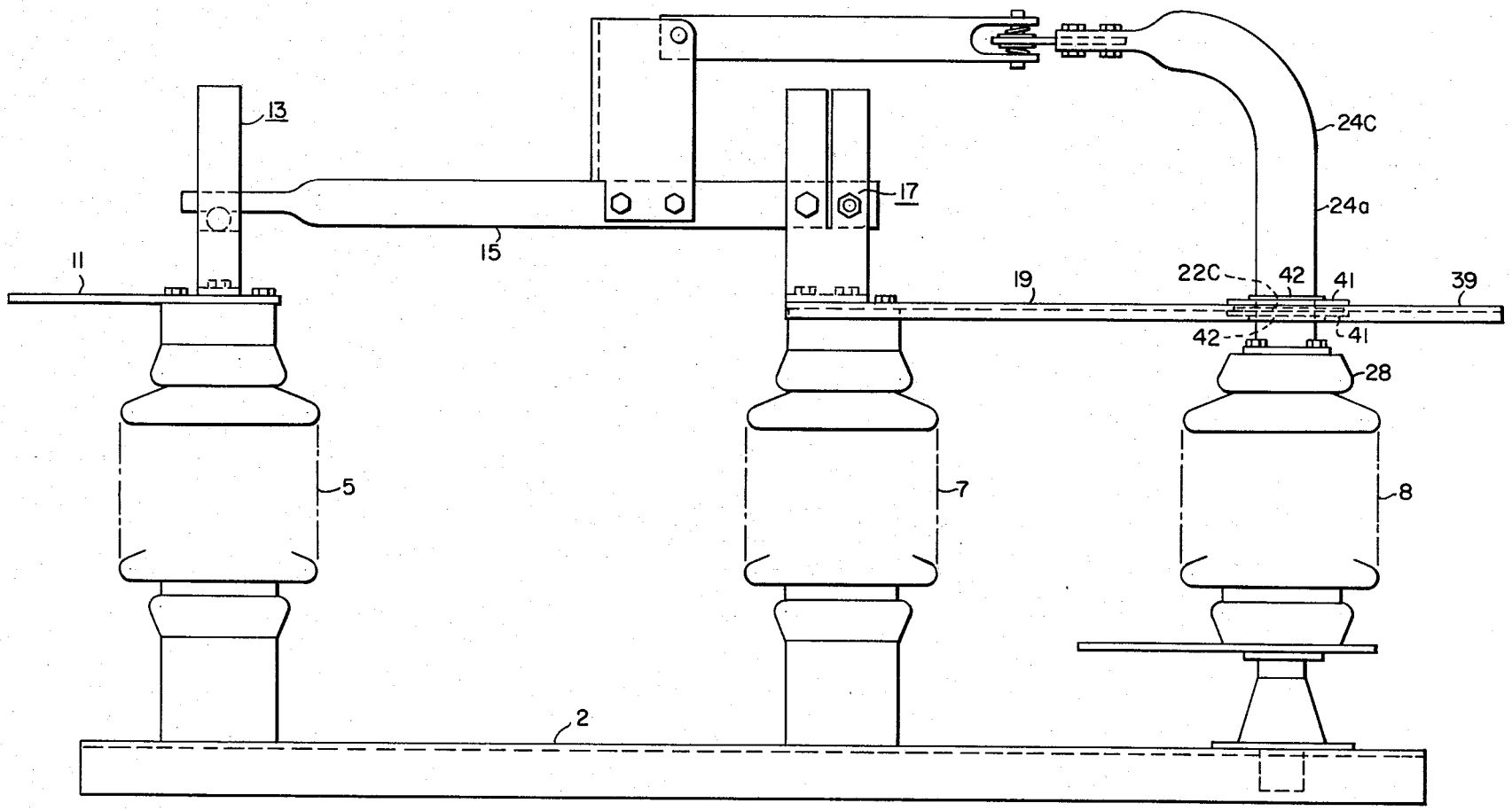
FIG. 9 illustrates a variation of the bearing and journal construction shown in FIG. 1, in which the bearing discs, provided on the shank portion of the crank-arm assembly, are located above the flange support portion of the crank-arm with the disc portion by retaining rings but still with the same journal plate in substitution of the usual heavy casting structures of the prior art.

Referring to the drawings and more particularly to FIG. 1 thereof, the reference numeral 1 generally designates a disconnecting switch structure having a base support 2 of generally channel-shaped metallic construction, and having supported upwardly therefrom, three post-type insulators 5, 7 and 8. At the upper end of the lefthand post insulator 5 is a line-terminal connection 11 and a stationary break-jaw contact assembly 13. Making electrical contacting engagement with the stationary break-jaw contact assembly 13 is a swinging movable switch-blade 15, the latter being pivotally mounted on a pivot pin 16 for swinging opening movement about a stationary hinge contact assembly 17.

As illustrated in FIG. 1, the middle post insulator support 7 assists in supporting at its upper end the hinge contact assembly 17 and also additionally a flat plate bridging conducting journal member 19, more clearly illustrated in FIGS. 7 and 8 of the drawings.

As well known by those skilled in the art, the rotation of the righthand insulator support 8 by a lower-disposed crank-arm 20 by any suitable means (not shown), will effect through an upper-disposed bearing means 22 concomitant corresponding rotative motion of an upper-disposed crank-arm assembly 24, which, in turn, effects, through linkage means 25, the upward swinging opening motion of the movable disconnecting switch-blade 15 to the dotted line open position, indicated by the reference numeral 26.

With reference being more particularly directed to FIG. 2 of the drawings, it will be observed that in accordance with the present invention there is provided an improved bearing means 22, comprising a pair of superimposed flat insulating bearings or discs 27, illustrated more in detail in FIGS. 3 and 4 of the drawings and commonly made of a material such as nylon. Disposed at the upper end of the rotatable post-insulator support 8 is an upper metallic insulator cap 28, having provided therein threaded openings 29 to thereby threadedly accommodate mounting bolts 30, which pass downwardly through a lower mounting flange portion 32 of the upper-disposed rotatable crank-arm assembly 24. The bearing discs 27 ride in the journal hole 33 of the journal plate 19. The mounting flange 32 is disposed on the upper side of the journal plate 19 to eliminate machining of the shank 24*a* of the crank-arm 24.

FIG. 5 illustrates a modified type of the invention with a bearing means 22A in which the metallic cap 28A of the rotatable insulator support 8 has a bearing surface, or groove 37 integrally cast therewith, which extends through the journal hole 33 provided in the conducting flat journal plate member 19. Here again, it will be noted that the mounting support flange 32, associated with the upper rotatable crank-arm assembly 24, is again on the upper side of the conducting journal plate 19, so that again no expensive machining operations need to be performed on the upper shank portion 24*a* of the rotatable crank-arm assembly 24.

FIG. 6 illustrates still another alternate bearing construction 22B, in which, again, the flange mounting support 32 of the rotatable crank-arm assembly 24 is disposed upwardly of the flat conducting journal plate 19, and again is affixed by mounting bolts 30 into the metallic insulator cap 28 to secure the two members together. Again, it will be noted that the bearing means 22B is provided below the mounting flange support 32 of the rotatable crank-arm assembly 24 of FIG. 6 and can be a disc of bearing material 32B or be the flange 32 itself which has a round bearing surface 32B to engage with the journal opening 33.

FIGS. 9–12 illustrate still a further modified switch construction in which the flat conducting journal plate 19, which electrically interconnects the relatively stationary but separate hinge assembly 17 with the right-hand line terminal pad 39, is utilized in the same fashion as in FIG. 1; however, a bearing 22C is in this modification positioned on the upper shank portion 24A of the rotatable crank-arm assembly 24C more clearly shown in FIG. 10. It will be noted that there is machined a pair of retaining grooves 40 on the shank portion 24A. A pair of superimposed insulating bearing discs 41, detailed in FIGS. 11 and 12, are passed over the upper end of the rotatable crank-arm assembly 24C and are secured into place by retaining rings 42, so that a resultant bearing means 22C is provided between the shank portion 24A of the crank-arm assembly 24C and the bearing aperture or journal 33 provided adjacent the righthand end of the conducting hinge plate 19 as shown in FIG. 7. It should be noted that here again the novel construction utilizing bus bar material and fabrication by stamping is possible because the hinge member 17 is separate and not integral with the journal member 19 as in the prior art, where member 17 and 19 are cast as one member.

By utilizing such a conducting flat bridging journal plate 19, as is shown in FIGS. 7 and 8, it will be noted that a considerable cost-saving is thus obviously effected. For example, the cost of the member 19 stamped from bus bar is of the order of $39.00, whereas the cost of a cast member combination according to the prior art, which requires machining, would be approximately $120.00. Thus, there results a cost-saving of substantially three-fourths in amount for each switch of approximately $81.00.

Where the higher current ratings are required in the operation of the switch 1, it is proposed to utilize a number of superimposed flat conducting plates 19 for the higher current ratings as shown in FIG. 13. Thus, for example, for a 2,000 ampere rating disconnecting switch, only one of the flat conducting plates, or "pans" 19 would be used. On the other hand, for a higher ampere switch rating, such as 3,000 amperes, for example, three such flat plates 19 would be utilized, disposed in superimposed relationship as illustrated in FIG. 13.

FIG. 14 is a variation of the construction illustrated in FIG. 2 wherein the discs 43 (FIG. 15) are attached by bolts 30 to the flange 32 but are disposed above the flange 32 and surround the shaft portion 24*a* of the crank-arm assembly 24 with the discs 43 having a clearance hole 43*a* provided therein, as shown more clearly in FIGS. 15 and 16.

Although there have been described and illustrated various arrangements of crank-arm bearing supports for the rotatable crank-arm assembly of a disconnecting switch, it is to be clearly understood that the same were merely for the purpose of illustration, and that changes and modifications will readily become apparent to those skilled in the art without departing from the spirit and scope of the invention.

What is claimed is:

1. A disconnecting switch comprising at least a pair of spaced generally-parallel disposed insulator supports (7, 8), one of which (8) is rotatable and the other insulator support (7) being stationary, a relatively-long, flat plate-like conducting bridging member (19) bridging the confronting ends of the pair of generally-parallel spaced insulator supports (7, 8), said relatively-long, flat plate-like bridging member (19) being fixedly secured to the end of the stationary insulator support (7) and having a journal opening (33) provided therein adjacent one end of the other rotatable insulator support (8), a stationary hinge assembly (17) constituting a separate entity from said relatively-long, flat plate-like bridging member (19) and supported by said stationary insulator support (7), a swinging disconnecting switch-blade assembly (15) pivotally mounted about said stationary hinge assembly (17), means defining a third spaced insulator support (5) supporting a stationary break-jaw contact assembly (13) with which the free end of the swinging disconnecting switch-blade assembly (15) makes separable contacting engagement during the opening and closing movements of the disconnecting switch, operating crank means (20) disposed adjacent the other end of said rotatable insulator support (8) for effecting the opening and closing rotative movement thereof, at least one insulating bearing disc (27) disposed within said journal opening (33) of said relatively-long, flat plate-like conducting bridging member (19), a rotatable crank-arm assembly (24) secured by one or more bolts (30) through said insulating bearing disc (27) to said one end of the rotatable insulator support to prevent current flow from said rotatable crank-arm assembly (24) to said relatively-long, flat plate-like bridging member (19), and linkage means (25) mechanically interconnecting the rotatable crank-arm assembly (24) with the swinging disconnecting switch-blade assembly (15) for effecting the opening and closing motions thereof.

2. The combination according to claim 1, wherein a plurality of flat, relatively-long plate-like conducting bridging members (19) are utilized for accommodating a greater current flow capacity through the disconnecting switch.

3. The combination according to claim 1, wherein the said insulating bearing disc (27) is fabricated from nylon.

4. The combination according to claim 1, wherein a pair of cooperable insulating bearing discs are provided, each of which has a shoulder portion provided therein and the assembly of the two insulating bearing discs cooperating together to straddle the periphery of the journal opening (33).

5. The combination according to claim 4, wherein the two cooperable bearing discs are fabricated from nylon.

* * * * *